US012535000B2

(12) United States Patent
Ejim et al.

(10) Patent No.: US 12,535,000 B2
(45) Date of Patent: Jan. 27, 2026

(54) ESTIMATING DOWNHOLE FLUID FLOW RATE FROM ESP EQUIPPED WITH WIRELESS SENSORS

(71) Applicant: SAUDI ARABIAN OIL COMPANY, Dhahran (SA)

(72) Inventors: Chidirim Enoch Ejim, Dhahran (SA); Hattan M. Banjar, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 74 days.

(21) Appl. No.: 18/478,113

(22) Filed: Sep. 29, 2023

(65) Prior Publication Data

US 2025/0109681 A1 Apr. 3, 2025

(51) Int. Cl.

| | |
|---|---|
| ***E21B 47/008*** | (2012.01) |
| ***E21B 43/12*** | (2006.01) |
| ***E21B 47/06*** | (2012.01) |
| ***E21B 47/10*** | (2012.01) |
| ***E21B 47/13*** | (2012.01) |

(52) U.S. Cl.

CPC ..... *E21B 47/10* (2013.01); *E21B 43/128* (2013.01); *E21B 47/008* (2020.05); *E21B 47/06* (2013.01); *E21B 47/13* (2020.05)

(58) Field of Classification Search

CPC ..... E21B 43/128; E21B 47/008; E21B 47/06

See application file for complete search history.

(56) References Cited

U.S. PATENT DOCUMENTS

| | | | | |
|---|---|---|---|---|
| 7,711,486 | B2 | 5/2010 | Thigpen et al. | |
| 8,571,798 | B2 | 10/2013 | Atherton | |
| 10,544,662 | B2 * | 1/2020 | Ding | E21B 43/2406 |
| 11,353,029 | B2 | 6/2022 | Hoefel et al. | |
| 11,668,594 | B2 | 6/2023 | Patel et al. | |
| 2015/0211526 | A1 | 7/2015 | Fastovets et al. | |
| 2019/0330971 | A1 * | 10/2019 | Xiao | E21B 47/06 |

(Continued)

OTHER PUBLICATIONS

Atkinson, Brian, "Wireless sensors improve pump reliability"; Processing Magazine; May 31, 2016; <https://www.processingmagazine.com/process-control-automation/instrumentation/article/15586685/wireless-sensors-improve-pump-reliability>; Accessed Sep. 28, 2023 (7 pages).

(Continued)

*Primary Examiner* — Catherine Loikith

(74) *Attorney, Agent, or Firm* — Osha Bergman Watanabe & Burton LLP

(57) ABSTRACT

A method to determine downhole fluid flow rate of a wellbore. The method includes generating, using sensors of a discharge sub and a suction sub coupled to an electrical submersible pump (ESP), monitoring data of the ESP that is suspended in the wellbore via a production tubing to facilitate well fluid flow to the Earth's surface through the production tubing, wirelessly transmitting, using wireless transmitters of the discharge sub and the suction sub, the monitoring data to a monitoring sub coupled to an electrical motor of the ESP, transmitting, by the monitoring sub to a downhole flow rate analyzer at the Earth's surface, monitoring data wirelessly received from the discharge sub and the suction sub, and determining, by the downhole flow rate analyzer, the downhole flow rate of the well fluid by analyzing the monitoring data.

15 Claims, 4 Drawing Sheets

(56) References Cited

U.S. PATENT DOCUMENTS

2021/0123322 A1 4/2021 De Long et al.

OTHER PUBLICATIONS

Abdalla, Ramez et al., "Real-Time Liquid Rate and Water Cut Prediction From the Electrical Submersible Pump Sensors Data Using Machine-Learning Algorithms"; ACS Omega; vol. 8, Issue 14; pp. 12671-12692; Apr. 11, 2023 (22 pages).
International Search Report issued for corresponding international patent application No. PCT/US2024/048520, mailed Jan. 13, 2025 (5 pages).
Written Opinion issued for corresponding international patent application No. PCT/US2024/048520, mailed Jan. 13, 2025 (10 pages).

* cited by examiner

ESTIMATING DOWNHOLE FLUID FLOW RATE FROM ESP EQUIPPED WITH WIRELESS SENSORS

BACKGROUND

In oil and gas industry, an electric submersible pump (ESP) system mainly consists of a pump (e.g., centrifugal pump), a protector, power delivery cable, a motor and a monitoring sub/tool. The pump is used to lift fluids (e.g., production fluids) to the surface or if at surface, transfers fluids from one location to another. The motor provides the mechanical power required to drive the pump via the shaft. The power delivery cable provides a means of supplying the motor with the needed electrical power from the surface. The protector absorbs the thrust load from the pump, transmits power from the motor to the pump, equalizes pressure, provides/receives additional motor oil as temperature changes and prevents well fluid from entering the motor. The pump consists of stages, which are made up of impellers and diffusers. The impeller, which is rotating, adds energy to the fluid to provide head, whereas the diffuser, which is stationary, converts the kinetic energy of fluid from the impeller into head. The pump stages are typically stacked in series to form a multi-stage system that is contained within a pump housing. The sum of head generated by each individual stage is summative such that the total head developed by the multi-stage system increases linearly from the first to the last stage. The monitoring sub/tool is installed onto the motor to measure parameters such as pump intake and discharge pressures, motor oil and winding temperature and vibration. Measured downhole data may be communicated to the surface via the power cable.

Downhole flow rates are conventionally determined by performing measurements at the surface using flow meters. Pressure and temperature corrections are then made to these measurements to ascertain the actual flow rate at pump intake conditions. The magnitude of the flow rate from these corrections can be susceptible to errors. Such errors lead to inaccurate operating range of the ESP, which may cause operation failures when exceeded. Furthermore, errors in flow rate measurements lead to inaccurate hydrocarbon allocation, which is detrimental to field asset planning and processing. These issues result in low overall operating efficiency of the field asset.

An alternative method of estimating downhole flow rates in the field is to use the factory tested and derived ESP stage performance (or catalogue) curves at a known fluid density. These performance curves, which are provided by the ESP vendor, include the head (or boost pressure) versus volumetric flowrate relationship of the pump, and may be expressed in the form on equation. For a change in fluid density, the boost pressure may be calculated from the known equation. This flowrate estimation approach may be inaccurate due to the fact that the stage performance may deteriorate with time as a result of erosion or corrosion, or if the fluid viscosity is higher than certain levels.

SUMMARY

In general, in one aspect, the invention relates to a method to determine downhole fluid flow rate of a wellbore, comprising generating, using sensors of a discharge sub and a suction sub coupled to an electrical submersible pump (ESP), monitoring data of the ESP, wherein the ESP is suspended in the wellbore via a production tubing to facilitate well fluid flow to the Earth's surface through the production tubing, wirelessly transmitting, using wireless transmitters of the discharge sub and the suction sub, the monitoring data to a monitoring sub coupled to an electrical motor of the ESP, transmitting, by the monitoring sub to a downhole flow rate analyzer at the Earth's surface, monitoring data wirelessly received from the discharge sub and the suction sub, and determining, by the downhole flow rate analyzer, the downhole flow rate of the well fluid by analyzing the monitoring data, wherein the determined downhole flow rate is used to facilitate a production operation of the wellbore.

In general, in one aspect, the invention relates to an electrical submersible pump (ESP) system for determining downhole fluid flow rate of a wellbore, comprising an ESP driven by an electrical motor and suspended in the wellbore via a production tubing to facilitate well fluid flow to the Earth surface through the production tubing, a discharge sub and a suction sub coupled to an ESP and comprising sensors that generate monitoring data of the ESP, wireless transmitters that wirelessly transmit the monitoring data to a monitoring sub coupled to the electrical motor, and the monitoring sub that transmit the monitoring data wirelessly received from the discharge sub and the suction sub to a downhole flow rate analyzer at the Earth surface or located in the monitoring sub, wherein the downhole flow rate analyzer determines the downhole flow rate of the well fluid by analyzing the monitoring data, and wherein the determined downhole flow rate is used to facilitate a production operation of the wellbore.

In general, in one aspect, the invention relates to a system comprising a downhole flow rate analyzer at the Earth surface, and an electrical submersible pump (ESP) system for determining downhole fluid flow rate of a wellbore, comprising an ESP driven by an electrical motor and suspended in the wellbore via a production tubing to facilitate well fluid flow to the Earth surface through the production tubing, a discharge sub and a suction sub coupled to an ESP and comprising sensors that generate monitoring data of the ESP, wireless transmitters that wirelessly transmit the monitoring data to a monitoring sub coupled to the electrical motor, and the monitoring sub that transmit the monitoring data wirelessly received from the discharge sub and the suction sub to a downhole flow rate analyzer at the Earth surface, wherein the downhole flow rate analyzer determines the downhole flow rate of the well fluid by analyzing the monitoring data, and wherein the determined downhole flow rate is used to facilitate a production operation of the wellbore.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (for example, first, second, third) may be used as an adjective for an element (that is, any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include a method and system to determine downhole fluid flow rate of a wellbore. In particular, an electrical submersible pump (ESP) is suspended in the wellbore via a production tubing to facilitate well fluid flow to the Earth's surface through the production tubing. During a wellbore operation, monitoring data of the ESP is generated using sensors of a discharge sub and a suction sub coupled to ESP. The monitoring data is wirelessly transmitted, using wireless transmitters of the discharge sub and the suction sub, to a monitoring sub coupled to an electrical motor of the ESP. In turn, the monitoring sub transmits the wirelessly received monitoring data to a downhole flow rate analyzer at the Earth's surface. Accordingly, the downhole flow rate analyzer determines the downhole flow rate of the well fluid by analyzing the monitoring data. The determined downhole flow rate is then used to facilitate a production operation of the wellbore.

Figure 1:
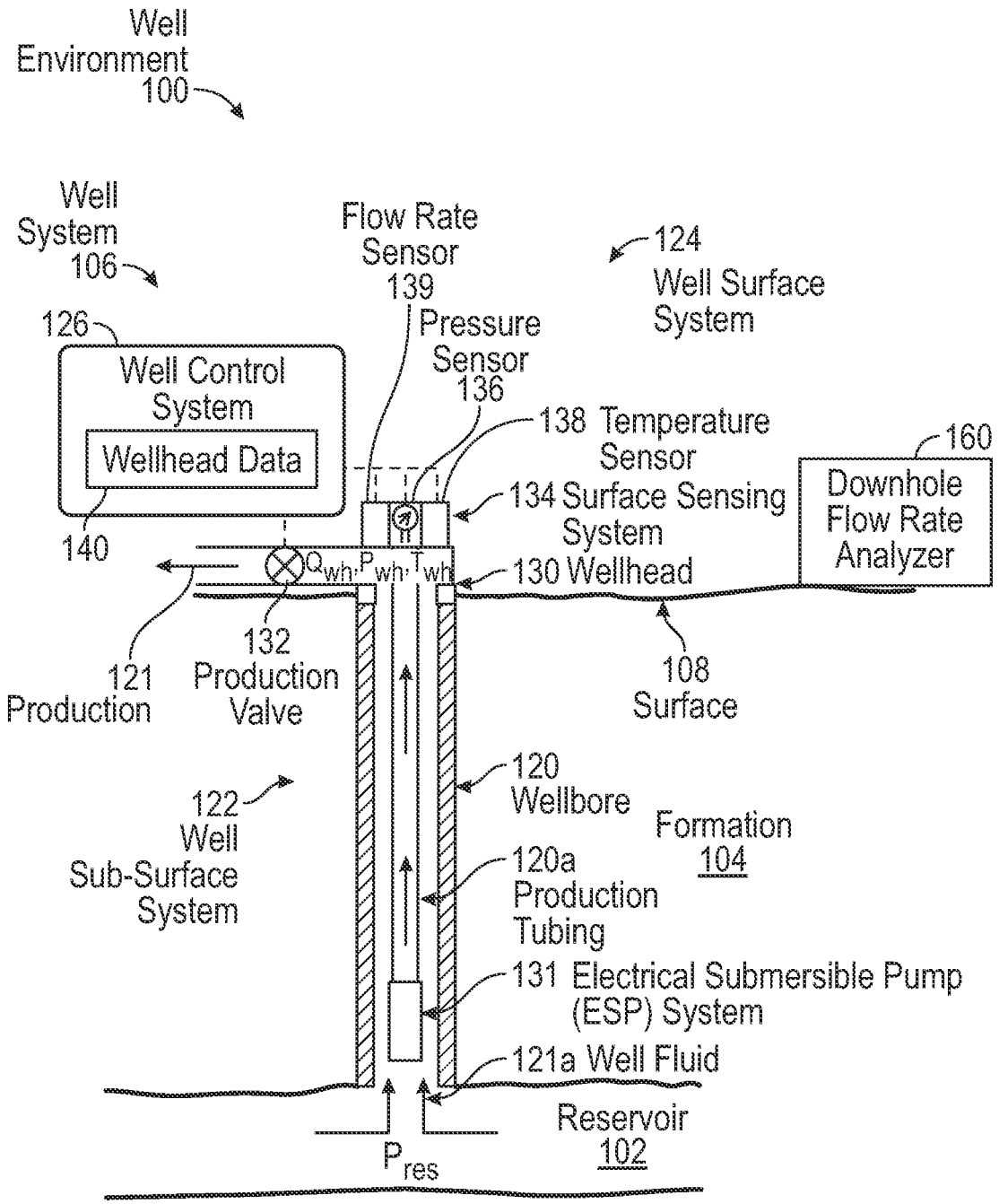
FIGS. 1-2 show a system in accordance with one or more embodiments.

FIG. 1 shows a schematic diagram in accordance with one or more embodiments. More specifically, FIG. 1 illustrates a well environment (100) that includes a hydrocarbon reservoir ("reservoir") (102) located in a subsurface hydrocarbon-bearing formation ("formation") (104) and a well system (106). The hydrocarbon-bearing formation (104) may include a porous or fractured rock formation that resides underground, beneath the Earth's surface ("surface") (108). In the case of the well system (106) being a hydrocarbon well, the reservoir (102) may include a portion of the hydrocarbon-bearing formation (104). The hydrocarbon-bearing formation (104) and the reservoir (102) may include different layers of rock (referred to as formation layers) having varying characteristics, such as varying degrees of permeability, porosity, capillary pressure, and resistivity. In the case of the well system (106) being operated as a production well, the well system (106) may facilitate the extraction of hydrocarbons (or "production") from the reservoir (102).

In some embodiments, the well system (106) includes a wellbore (120), a well sub-surface system (122), a well surface system (124), and a well control system ("control system") (126). The control system (126) may control various operations of the well system (106), such as well production operations, well completion operations, well maintenance operations, and reservoir monitoring, assessment and development operations. In some embodiments, the control system (126) includes a computer system that is the same as or similar to that of the computer system (400) described below in FIG. 4 and the accompanying description.

The wellbore (120) may include a bored hole that extends from the surface (108) into a target zone of the hydrocarbon-bearing formation (104), such as the reservoir (102). An upper end of the wellbore (120), terminating at or near the surface (108), may be referred to as the "up-hole" end of the wellbore (120), and a lower end of the wellbore, terminating in the hydrocarbon-bearing formation (104), may be referred to as the "down-hole" end of the wellbore (120). The wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the hydrocarbon-bearing formation (104) or the reservoir (102) during injection operations, or the communication of monitoring devices (e.g., logging tools) into the hydrocarbon-bearing formation (104) or the reservoir (102) during monitoring operations (e.g., during in situ logging operations).

In some embodiments, during operation of the well system (106), the control system (126) collects and records wellhead data (140) for the well system (106). The wellhead data (140) may include, for example, a record of measurements of wellhead pressure ($P_{wh}$) (e.g., including flowing wellhead pressure), wellhead temperature ($T_{wh}$) (e.g., including flowing wellhead temperature), wellhead production rate ($Q_{wh}$) over some or all of the life of the well system (106), and water cut data. In some embodiments, the measurements are recorded in real-time, and are available for review or use within seconds, minutes or hours of the condition being sensed (e.g., the measurements are available within 1 hour of the condition being sensed). In such an embodiment, the wellhead data (140) may be referred to as "real-time" wellhead data (140). Real-time wellhead data (140) may enable an operator of the well system (106) to assess a relatively current state of the well system (106), and make real-time decisions regarding development of the well system (106) and the reservoir (102), such as on-demand adjustments in regulation of production flow from the well.

In some embodiments, the well sub-surface system (122) includes casing installed in the wellbore (120). For example, the wellbore (120) may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In some embodiments, the casing includes an annular casing that lines the wall of the wellbore (120) to define a central passage that provides a conduit for the transport of tools and substances through the wellbore (120). For example, the central passage may provide a conduit for lowering logging tools into the wellbore (120), a conduit for the flow of production (121) (e.g., oil and gas) from the reservoir (102) to the surface (108), or a conduit for the flow of injection substances (e.g., water) from the surface (108) into the hydrocarbon-bearing formation (104). In some embodiments, the well sub-surface system (122) includes production tubing (120*a*) installed in the wellbore (120). The production tubing (120*a*) may provide a conduit for the transport of tools and substances through the wellbore (120). The production tubing (120*a*) may, for example, be disposed inside casing. In such an embodiment, the production tubing (120*a*) may provide a conduit for some or all of the production (121) (e.g., oil and gas) passing through the wellbore (120) and the casing. For example, well fluid (121*a*) may enter the wellbore (120) from the formation (104) and is lifted using an electrical submersible pump (ESP) system (131) to the surface (108) via the production tubing (120*a*) to produce the production (121).

In some embodiments, the well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures for supporting (or "hanging") casing and production tubing extending into the wellbore (120). Production (121) may flow through the wellhead (130), after exiting the wellbore (120) and the well sub-surface system (122), including, for example, the casing and the production tubing. In some embodiments, the well surface system (124) includes flow regulating devices that are operable to control the flow of substances into and out of the wellbore (120). For example, the well surface system (124) may include one or more production valves (132) that are operable to control the flow of production (121). For example, a production valve (132) may be fully opened to enable unrestricted flow of production (121) from the wellbore (120), the production valve (132) may be partially opened to partially restrict (or "throttle") the flow of production (121) from the wellbore (120), and production valve (132) may be fully closed to fully restrict (or "block") the flow of production (121) from the wellbore (120), and through the well surface system (124).

In some embodiments, the wellhead (130) includes a choke assembly. For example, the choke assembly may include hardware with functionality for opening and closing the fluid flow through pipes in the well system (106). Likewise, the choke assembly may include a pipe manifold that may lower the pressure of fluid traversing the wellhead. As such, the choke assembly may include a set of high-pressure valves and at least two chokes. These chokes may be fixed or adjustable or a mix of both. Redundancy may be provided so that if one choke has to be taken out of service, the flow can be directed through another choke. In some embodiments, pressure valves and chokes are communicatively coupled to the well control system (126). Accordingly, a well control system (126) may obtain wellhead data regarding the choke assembly as well as transmit one or more commands to components within the choke assembly in order to adjust one or more choke assembly parameters.

Keeping with FIG. 1, in some embodiments, the well surface system (124) includes a surface sensing system (134). The surface sensing system (134) may include sensors for sensing characteristics of substances, including production (121), passing through or otherwise located in the well surface system (124). The characteristics may include, for example, pressure, temperature and flow rate of production (121) flowing through the wellhead (130), or other conduits of the well surface system (124), after exiting the wellbore (120).

In some embodiments, the surface sensing system (134) includes a surface pressure sensor (136) operable to sense the pressure of production (121) flowing through the well surface system (124), after it exits the wellbore (120). The surface pressure sensor (136) may include, for example, a wellhead pressure sensor that senses a pressure of production (121) flowing through or otherwise located in the wellhead (130). In some embodiments, the surface sensing system (134) includes a surface temperature sensor (138) operable to sense the temperature of production (121) flowing through the well surface system (124), after it exits the wellbore (120). The surface temperature sensor (138) may include, for example, a wellhead temperature sensor that senses a temperature of production (121) flowing through or otherwise located in the wellhead (130), referred to as "wellhead temperature" (Twh). In some embodiments, the surface sensing system (134) includes a flow rate sensor (139) operable to sense the flow rate of production (121) flowing through the well surface system (124), after it exits the wellbore (120). The flow rate sensor (139) may include hardware that senses a flow rate of production (121) (Qwh) passing through the wellhead (130).

In some embodiments, the well system (106) includes a downhole flow rate analyzer (160). For example, the downhole flow rate analyzer (160) may include hardware and/or software with functionality for estimating downhole flow rate of the well fluid (121*a*) flowing through the production tubing (120*a*). For example, the estimated downhole flow rate may be used as input to the well control system (126) for controlling or adjusting the production (121). Based on the estimated downhole flow rate, the well control system (126) may generate and send a control signal to the choke assembly for controlling or adjusting the production (121) to match a target production rate. In another example, the estimated downhole flow rate may be used to predict or forecast field performance and ultimate recovery for various field development scenarios.

While the downhole flow rate analyzer (160) is shown at a well site, embodiments are contemplated where at least a portion of the downhole flow rate analyzer (160) is located away from well sites. In some embodiments, at least a portion of the downhole flow rate analyzer (160) is integrated with the well control system (126). In other embodiments, the downhole flow rate analyzer (160) is located in the monitoring sub. In some embodiments, the downhole flow rate analyzer (160) includes a computer system that is similar to the computing device (400) described below with regard to FIG. 4 and the accompanying description.

Figure 2:
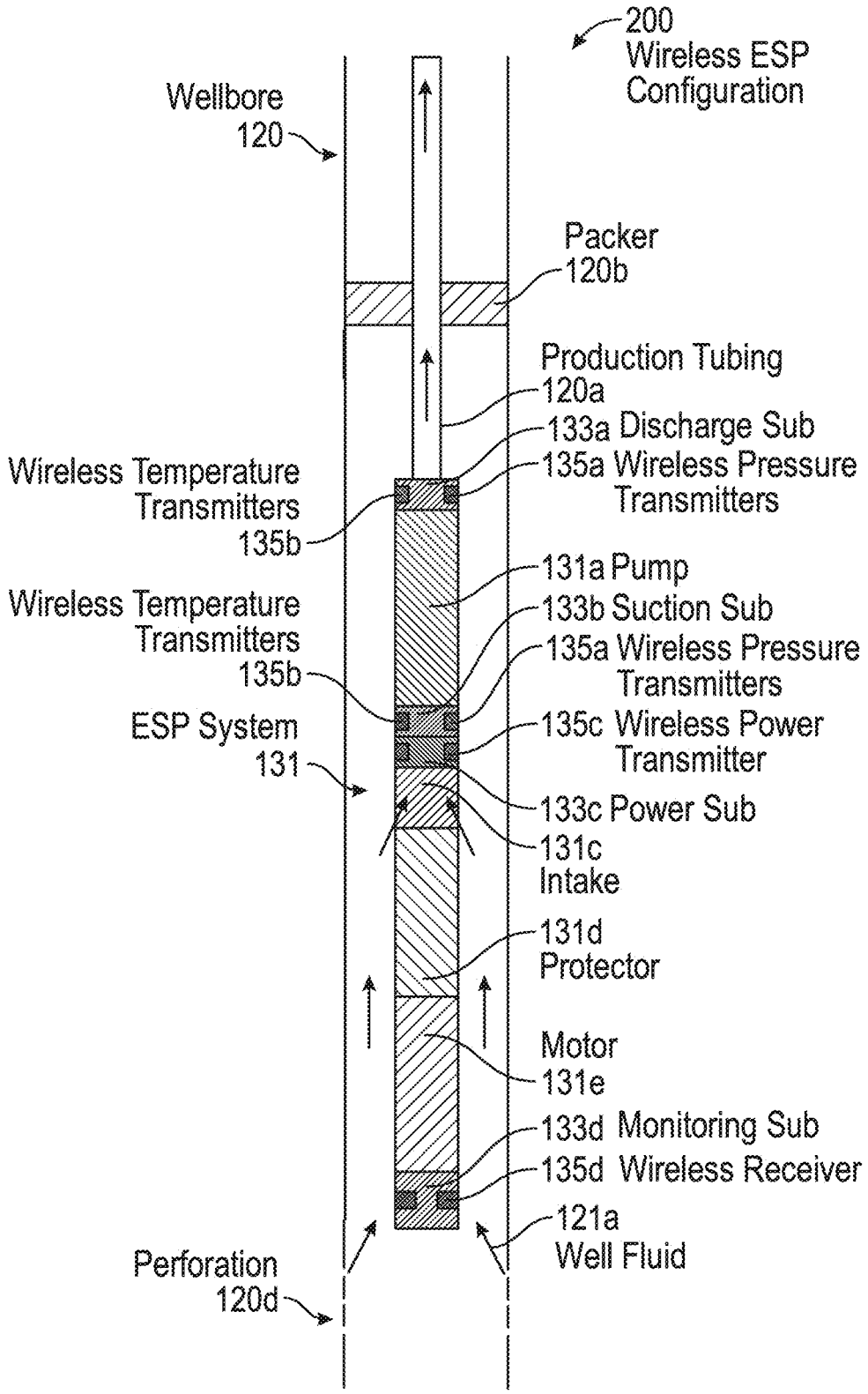

FIG. 2 shows a schematic diagram in accordance with one or more embodiments. More specifically, FIG. 2 illustrates an ESP configuration (200) of the ESP system (131) depicted in FIG. 1 above. In one or more embodiments, one or more of the modules and/or elements shown in FIG. 2 may be omitted, repeated, and/or substituted. Accordingly, embodiments of the invention should not be considered limited to the specific arrangements of modules and/or elements shown in FIG. 2.

As shown in FIG. 2, the ESP system (131) is used to lift well fluid (121*a*) from perforation (120*d*) into the production tubing (120*a*) that is disposed in the wellbore (120) shown with or without a packer (120*b*). The ESP system (131) includes a pump (131*a*), intake (131*c*), protector (131*d*), motor (131*e*), and monitoring sub (133*d*). As noted above, the pump (131*a*) may be a centrifugal pump. The intake (131*c*) is an opening to receive and transfer the well fluid (121*a*) into the pump (131*a*). The motor (131*e*) provides mechanical power required to drive the pump (131*a*) via a shaft. The protector (131*d*) absorbs the thrust load from the pump (131*a*), transmits mechanical power from the motor (131*e*) to the pump (131*a*), equalizes pressure, provides/receives additional motor oil as temperature changes and prevents well fluid (121*a*) from entering the motor (131*e*). The term "sub" refers to a mechanical sub-assembly. In particular, the monitoring sub (133*d*) includes means for generating or otherwise obtaining downhole monitoring data, such as motor oil and winding temperature, pump intake and discharge pressures, and mechanical vibration. Measured downhole data may be communicated to the surface (108) from the monitoring sub (133*d*) via various downhole data transmission means. For example, a power delivery cable that provides a means of supplying the motor (131*e*) with the needed electrical power from the surface (108) may be adapted to transmit the measured downhole data from the monitoring sub (133*d*) to the surface (108).

In the conventional ESP configuration, pressure and temperature measurements obtained by the monitoring sub are obtained via physical connection of a hydraulic line connecting the monitoring sub to the inlet and outlet of the pump. This configuration is susceptible to issues related to plugging, bending and sometimes outright damage of the hydraulic line. When this occurs, monitoring data of ESP conditions is no longer available leading to a loss in monitoring capability of the ESP system. Inability to obtain some of these in-situ measurements implies the surface corrections of the downhole sensor measurement is not possible to ascertain the downhole flow rate. In severe cases, a decision may be made to retrieve the ESP system for repair. This results in production delays and workover costs.

In the ESP configuration (200) as shown in FIG. 2, a discharge sub (133*a*), a suction sub (133*b*), and a power sub (133*c*) of the ESP system (131) include sensors having built-in wireless transmitters (referred to as wireless sensor/transmitters). The discharge sub couples the downstream terminal (i.e., outlet) of the pump (131*a*) to the production tubing (120*a*). The suction sub (133*b*) and power sub (133*c*) collectively couple the upstream terminal (i.e., inlet) of the pump (131*a*) to the intake (131*c*). In addition, the discharge sub (133*a*) includes a wireless pressure sensor/transmitter (135*a*) and a wireless temperature sensor/transmitter (135*b*) that measure fluid pressure and temperature at the outlet of the pump (131*a*). The suction sub (133*b*) also includes a wireless pressure sensor/transmitter (135*a*) and a wireless temperature sensor/transmitter (135*b*) that measure fluid pressure and temperature at the inlet of the pump (131*a*). Immediately upstream of the suction sub (133*b*) is the power sub (133*c*) that includes a wireless power sensor/transmitter (135*c*) that measure mechanical input power to the pump (131*a*) delivered from the motor (131*e*). The measured fluid pressure and temperature at the inlet and outlet of the pump (131*a*) and the measured mechanical input power are referred to as monitoring data and are transmitted using wireless signals. The monitoring sub (133*d*) has a built-in wireless receiver (135*d*), which picks up the wireless signals from the discharge, suction and power subs and communicates the monitoring data to the surface (108), e.g., via the power cable. Alternatively, the monitoring data may be processed by a computer processor within the monitoring sub (133*d*) before communicating the processed data to the surface (108). Upon transmitting to the surface (108), the unprocessed and/or processed monitoring data are received and analyzed by the downhole flow rate analyzer (160) to determine an estimated downhole flow rate.

In some embodiments, the monitoring sub (133*d*) may include a sensor that measures vibration of the ESP. The vibration measurements are added to the wirelessly received monitoring data to be transmitted to surface for condition monitoring.

In some embodiments, the discharge and suction subs may be standalone units or embedded units that are integrated into the ESP system (131).

In some embodiments, the ESP system (131) may be used in an alternative deployed ESP assembly, such as a cable deployed ESP, in either a conventional or inverted configuration. In some embodiments, the ESP system (131) may be used for an inverted tubing-deployed ESP assembly.

While FIG. 2 shows that the pump (131*a*) is located up hole from the motor (131*e*) and the monitoring sub (133*d*), the pump (131*a*) may be located downhole from the motor (131*e*) and the monitoring sub (133*d*) in a variation of the wireless configuration (200) without deviating from the mechanism and method described herein.

To determine the downhole flow rate, pump hydraulics and application of the steady flow energy equation may be employed. Eq. (1) based on the pump hydraulics and Eq. (2) of the steady flow energy equation may be used.

$$\text{Pump Efficiency, } \eta_P = \frac{\text{Change in Fluid Mechanical Power Between Pump Discharge and Suction}}{\text{Mechanical Power Input to the Pump}(\text{POWER}_{IN})} \quad \text{Eq. (1)}$$

$$\text{POWER}_{IN} = \dot{m}\left\{\left[\frac{P_d}{\rho_d} - \frac{P_s}{\rho_s}\right] + \left[\frac{\dot{m}^2}{2}\left(\frac{1}{\rho_d^2 A_d^2} - \frac{1}{\rho_s^2 A_s^2}\right)\right] + [g(L_d - L_s)\cos\theta_v] + [C_v(T_d - T_s) - q_{net_input}]\right\} \quad \text{Eq. (2)}$$

In Eq. (2), subscripts "d" and "s" denote the discharge and suction locations (i.e., outlet and inlet), respectively of the pump (131*a*). The first, second, third and fourth terms in the square ([ ]) brackets are attributed to the specific flow energy difference, kinetic energy difference, potential energy difference and mechanical energy loss per unit mass flow rate of the well fluid (121*a*), respectively.

The notations are defined as follows:

$\text{POWER}_{IN}$=mechanical power input to the pump $\dot{m}$=fluid mass flow rate P=absolute static pressure of the fluid ρ=Fluid density A=measurement cross-sectional area $(L_d - L_s)$=Axial length difference between the discharge and suction measurement locations $\theta_v$=deviation (or inclination) of the ESP assembly from the vertical axis $C_v$=fluid specific heat capacity at constant volume T=Absolute static temperature of the fluid $q_{net_input}$=net heat input to the system (positive if net heat transfer is into the system; negative if net heat transfer is from the system)

The parameters in Eq. (2) are described in further details below.

A and $(L_d - L_s)$ are measurement cross-sectional flow area and axial length difference, respectively that are known geometrical properties of the specific ESP system (131). The wetted surfaces of the components at the measurement locations are coated or surface-treated to be resistant to abrasion, erosion, and corrosion. Furthermore, these surfaces are anti-adherent to downhole solids and/or scale deposits.

$\theta_v$ is the deviation that depends on the setting depth of the ESP system (131). This information is a wellbore parameter known from the deviation survey obtained prior to installing the ESP system (131) into the wellbore (120).

T, P, $\text{POWER}_{IN}$ are the temperatures, pressures, and input power, respectively that are measured wirelessly by the discharge, suction and power subs.

$C_v$ is the fluid specific heat capacity at constant volume that is a known property of the given single-phase fluid from prior tests specific to the given wellbore.

ρ is the density that is a known property of the single phase well fluid (121*a*) in the wellbore (120). It varies with temperature and is obtained from well tests and standard field PVT analysis.

$q_{net_input}$ is the net heat transfer input to the ESP system (131) that may be obtained from the product of the convective heat transfer coefficient, surface area of the pump housing and the temperature difference between the surface of the pump housing, and the ambient/well bore environment (i.e., skin temperature difference). Computation of the convective heat transfer coefficient and the skin temperature difference can be complex and requiring an iterative process. For the main intent of this disclosure, the net transfer may be considered relatively negligible.

Referring back to Eq. (2), all the parameters are known except the mass flow rate ($\dot{m}$). The form of Eq. (2) cannot be solved explicitly for the mass flow rate, instead an iterative process is employed. After the mass flow rate is obtained, the volume flow rate at any measurement location may be determined by dividing the mass flow rate with the corresponding liquid density.

With the fluid mass flow rate determined, it is possible to obtain the actual pump efficiency during downhole operation. Referring back to Eq. (1), the numerator is the sum of the first, second, and third terms in the square ([ ]) brackets, which are attributed to the specific flow energy difference, kinetic energy difference and potential energy difference per unit mass flow rate of the well fluid (121*a*), respectively. Substituting these and Eq. (2) into Eq. (1) gives Eq. (3) below.

$$\text{Pump Efficiency, } \eta_P = \frac{\left\{\left[\frac{P_d}{\rho_d} - \frac{P_s}{\rho_s}\right] + \left[\frac{\dot{m}^2}{2}\left(\frac{1}{\rho_d^2 A_d^2} - \frac{1}{\rho_s^2 A_s^2}\right)\right] + [g(L_d - L_s)\cos\theta_v]\right\}}{\left\{\left[\frac{P_d}{\rho_d} - \frac{P_s}{\rho_s}\right] + \left[\frac{\dot{m}^2}{2}\left(\frac{1}{\rho_d^2 A_d^2} - \frac{1}{\rho_s^2 A_s^2}\right)\right] + [g(L_d - L_s)\cos\theta_v] + [C_v(T_d - T_s) - q_{net_input}]\right\}} \quad \text{Eq. (3)}$$

In some embodiments, the power sub (133*c*) is not available and the mass flow rate is estimated by assuming that the power input $\text{POWER}_{IN}$ of Eq. (2) is approximately equal to the power output from the electric motor (131*e*). This assumption introduces errors in the flow rate estimation since due to mechanical power loss in the protector (131*d*) as the motor (131*e*) transmits power to the pump (131*a*). If it is assumed that this mechanical power loss is negligible relative to the power output from the motor (131*e*), then the left-hand side of Eq. (2) may be approximated to:

$$\text{POWER}_{IN} = \text{Motor Mechanical Efficiency } (\eta_M) * \text{Motor Electrical Power Input} \quad \text{Eq. (4)}$$

The motor mechanical efficiency is a known value and for permanent magnet motors, this value is relatively constant over a wide range of operating speeds. The motor electrical input power may be computed from readings of the variable speed drive (VSD) at the surface and considering the electrical power loss from the VSD to the motor terminals downhole. Computation of the mass flow rate and corresponding volume flow rate is similar to the description described above.

An example of pumping operation when handling liquids downhole is described below where the downhole flow rate analyzer (160) is used to facilitate the pumping operation. When the ESP system (131) is energized, the discharge temperatures and pressures are measured by the discharge sub (133*a*) and transmitted wirelessly to the monitoring sub (133*d*). Similarly, the suction temperatures and pressures are measured by the suction sub (133*b*) and transmitted wirelessly to the monitoring sub (133*d*). The power sub (133*c*) measures the intake power to the pump (131*a*) and transmits it wirelessly to the monitoring sub (133*d*). The monitoring sub (133*d*) transmits the received monitoring data to the downhole flow rate analyzer (160) at the surface via the power cable, where the monitoring data is processed to compute the flow rates and pump efficiency using Eq. (2) and Eq. (3), respectively. Alternatively, the monitoring data may be processed by a computer processor downhole before transmitting the computed magnitude of the flow rates and pump efficiencies to the surface via the power cable.

Figure 3:
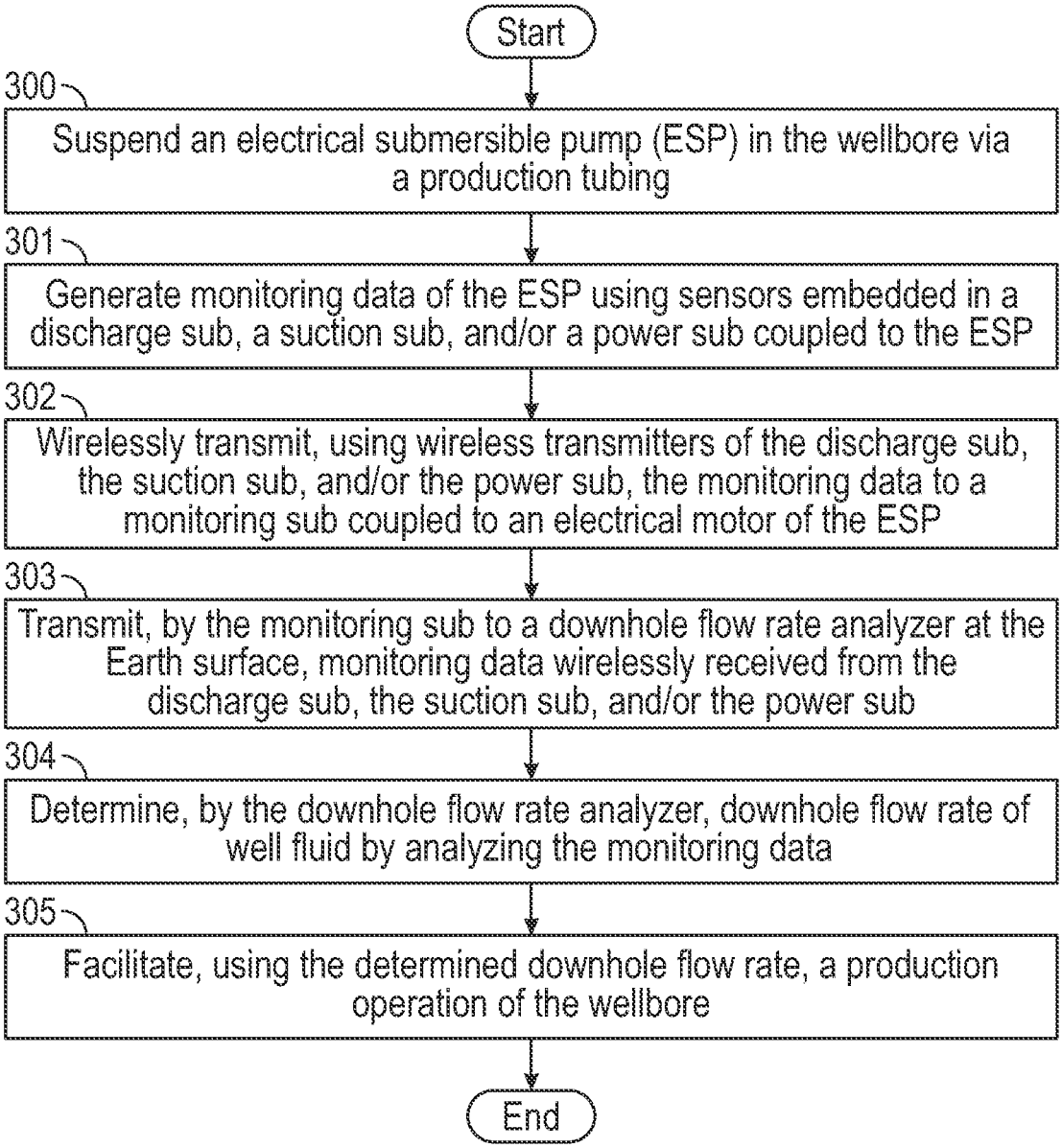
FIG. 3 shows a method flowchart in accordance with one or more embodiments.

FIG. 3 shows a flowchart in accordance with one or more embodiments disclosed herein. Specifically, FIG. 3 illustrates a method to determine downhole fluid flow rate and to facilitate fluid flow to the Earth surface through a production tubing in the wellbore. One or more of the steps in FIG. 3 may be performed by the components of the well environment (100) and the downhole flow rate analyzer (160), discussed above in reference to FIGS. 1-2. In one or more embodiments, one or more of the steps shown in FIG. 3 may be omitted, repeated, and/or performed in a different order than the order shown in FIG. 3. Accordingly, the scope of the disclosure should not be considered limited to the specific arrangement of steps shown in FIG. 3.

Initially in Step 300, an electrical submersible pump (ESP) is suspended in the wellbore via a production tubing.

In Step 301, monitoring data of the ESP is generated using sensors of a discharge sub, a suction sub, a monitoring sub, and/or a power sub coupled to the ESP. The sensors of the discharge sub measure discharge temperature and discharge pressure of the well fluid at an outlet of the ESP. The sensors of the suction sub measure suction temperature and suction pressure of the well fluid at an inlet of the ESP. The sensors of the monitoring sub measure motor oil and winding temperature, intake and discharge pressure and mechanical vibration. The sensors of the power sub measure mechanical power input to the ESP.

In Step 302, the monitoring data is wirelessly transmitted, using wireless transmitters of the discharge sub, the suction sub, and/or the power sub, to the monitoring sub coupled to an electrical motor of the ESP. In some embodiments, the wireless transmitters transmit electromagnetic signals.

In Step 303, monitoring data wirelessly received from the discharge sub, the suction sub, and/or the power sub, is transmitted by the monitoring sub to a downhole flow rate analyzer at the Earth surface. In addition, the monitoring data generated by the monitoring sub itself is also transmitted together with the wirelessly received monitoring data from the discharge sub, the suction sub, and/or the power sub. In one or more embodiments, the monitoring data is transmitted by the monitoring sub to the downhole flow rate analyzer via a power delivery cable of the ESP.

In Step 304, the downhole flow rate of the well fluid is determined by the downhole flow rate analyzer analyzing the monitoring data. In one or more embodiments, the downhole flow rate analyzer computes the downhole flow rate using Eq. (1) through Eq. (4) described above.

In Step 305, the determined downhole flow rate is used to facilitate a production operation of the wellbore, e.g., facilitating well fluid flow to the Earth surface through the production tubing.

Embodiments disclosed herein advantageously enable measurement of pump parameters without physical hydraulic lines, which avoids issues associated with using hydraulic lines for measurements, such as plugging, bending or total damage. The invention also avoids expense associated with workovers and deferred production if the decision is to retrieve the ESP. The system enables computation of flow rates downhole, which is more accurate than surface flow measurements with corrections. More accurate flow rate computation facilitates proper hydrocarbon allocation from the field asset. Further, capability of measuring flow rate downhole reduces equipment footprint at surface.

The embodiments disclosed above do not limit in any way the scope of this invention. Different combinations and/or variations of the components, systems, and/or procedures described above may be implemented as below.

Although the procedure for a single-phase liquid is described in this disclosure, the approach can be applied to a liquid-liquid system (for example, oil and water), or for a gas-liquid system, provided the water cut can be determined to obtain the effective liquid-liquid mixture fluid properties such as density and specific heat capacity at constant volume. A water-cut measurement method may include an inline capacitance-based measurement that leverages the relatively large difference in dielectric constant between oil and water.

Similarly, the disclosed procedure may be applied to a gas-liquid system (e.g., oil-water-gas system), provided the respective mass fractions of the different fluid components are ascertained to enable the estimation of the effective mixture p and Cy.

Figure 4:
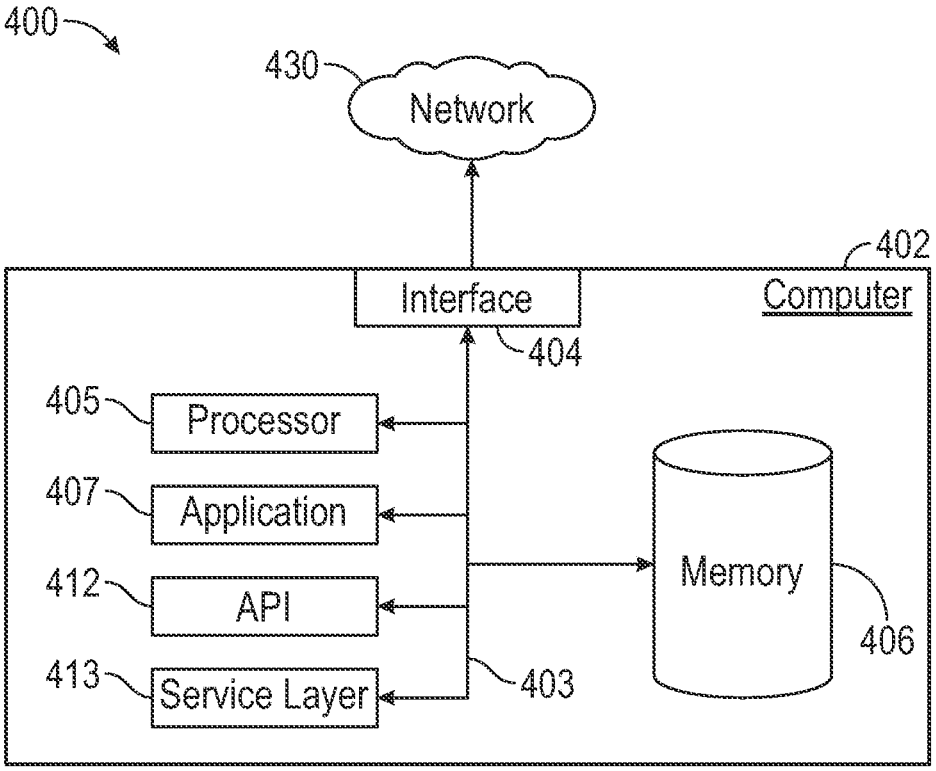
FIG. 4 shows a computing system in accordance with one or more embodiments.

Embodiments may be implemented on a computer system. FIG. 4 is a block diagram of a computer system (402) used to provide computational functionalities associated with described algorithms, methods, functions, processes, flows, and procedures as described in the instant disclosure, according to an implementation. The illustrated computer (402) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or other suitable format. While illustrated as an integrated component of the computer (402), alternative implementations may illustrate the API (412) or the service layer (413) as standalone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing computer (402), each computer (402) communicating over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

In some embodiments, the computer (402) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method to determine downhole fluid flow rate of a wellbore, comprising:

generating, using sensors of a discharge sub and a suction sub coupled to an electrical submersible pump (ESP), monitoring data of the ESP, wherein the ESP is suspended in the wellbore via a production tubing to facilitate well fluid flow to the Earth's surface through the production tubing, wherein the discharge sub couples the ESP to the production tubing and includes at least a first one of the sensors, wherein the suction sub couples the ESP to an electrical motor of the ESP and includes at least a second one of the sensors;

generating, using additional sensors of a power sub coupled to the ESP, additional monitoring data of the ESP;

wirelessly transmitting, using wireless transmitters of the discharge sub, the suction sub, and the power sub, the monitoring data and the additional monitoring data to a monitoring sub coupled to the electrical motor;

transmitting, by the monitoring sub to a downhole flow rate analyzer, the monitoring data and the additional monitoring data wirelessly received from the discharge sub and the suction sub; and determining, by the downhole flow rate analyzer, the downhole flow rate of the well fluid by analyzing the monitoring data and the additional monitoring data, wherein the sensors of the discharge sub measure discharge pressure of the well fluid at an outlet of the ESP, wherein the sensors of the suction sub measure suction pressure of the well fluid at an inlet of the ESP, wherein the additional sensors of the power sub measure mechanical power input to the ESP and wherein the determined downhole flow rate is used to facilitate a production operation of the wellbore.

2. The method of claim 1, wherein the monitoring data and the additional monitoring data are transmitted by the monitoring sub to the downhole flow rate analyzer via a power delivery cable of the ESP.

3. The method of claim 1, wherein the sensors of the discharge sub measure discharge temperature of the well fluid at an outlet of the ESP, and wherein the sensors of the suction sub measure suction temperature of the well fluid at an inlet of the ESP.

4. The method of claim 1, wherein the wireless transmitters and the additional wireless transmitters transmit electromagnetic signals.

5. The method of claim 1, further comprising:

generating, using sensors of the monitoring sub, additional monitoring data comprising measurements of one or more of motor oil and winding temperature, intake and discharge pressure, and mechanical vibration, wherein the additional monitoring data is combined with the monitoring data for transmitting to the downhole flow rate analyzer for determining the downhole flow rate, and wherein the downhole flow rate analyzer is disposed at the Earth surface or integrated within the monitoring sub.

6. An electrical submersible pump (ESP) system for determining downhole fluid flow rate of a wellbore, comprising:

an ESP driven by an electrical motor and suspended in the wellbore via a production tubing to facilitate well fluid flow to the Earth surface through the production tubing;

a discharge sub and a suction sub comprising:

sensors that generate monitoring data of the ESP; and wireless transmitters that wirelessly transmit the monitoring data, wherein the discharge sub couples the ESP to the production tubing and includes at least a first one of the sensors, wherein the suction sub couples the ESP to the electrical motor and includes at least a second one of the sensors, wherein the sensors of the discharge sub measure discharge pressure of the well fluid at an outlet of the ESP, and wherein the sensors of the suction sub measure suction pressure of the well fluid at an inlet of the ESP;

a power sub coupled to the ESP and comprising:

additional sensors that generate additional monitoring data of the ESP; and additional wireless transmitters that wirelessly transmit the additional monitoring data, wherein the additional sensors of the power sub measure mechanical power input to the ESP; and a monitoring sub coupled to the electrical motor, wherein the monitoring sub receives the monitoring data wirelessly transmitted from the discharge sub and the suction sub, wherein the monitoring sub receives the additional monitoring data wirelessly transmitted from the power sub, and wherein the monitoring sub transmits the monitoring data and the additional monitoring data to a downhole flow rate analyzer, wherein the downhole flow rate analyzer determines the downhole flow rate of the well fluid by analyzing the monitoring data and the additional monitoring data, and wherein the determined downhole flow rate is used to facilitate a production operation of the wellbore.

7. The ESP system of claim 6, wherein the monitoring data and the additional monitoring data are transmitted by the monitoring sub to the downhole flow rate analyzer via a power delivery cable of the ESP.

8. The ESP system of claim 6, wherein the sensors of the discharge sub measure discharge temperature of the well fluid at an outlet of the ESP, and wherein the sensors of the suction sub measure suction temperature of the well fluid at an inlet of the ESP.

9. The ESP system of claim 6, wherein the wireless transmitters and the additional wireless transmitters transmit electromagnetic signals.

10. The ESP system of claim 6, the monitoring sub comprising sensors that generate additional monitoring data comprising measurements of one or more of motor oil and winding temperature, intake and discharge pressure, and mechanical vibration, wherein the additional monitoring data is combined with the monitoring data for transmitting to the downhole flow rate analyzer for determining the downhole flow rate, and wherein the downhole flow rate analyzer is disposed at the Earth surface or integrated within the monitoring sub.

11. A system comprising:

a downhole flow rate analyzer; and an electrical submersible pump (ESP) system for determining downhole fluid flow rate of a wellbore, comprising:

an ESP driven by an electrical motor and suspended in the wellbore via a production tubing to facilitate well fluid flow to the Earth surface through the production tubing;

a discharge sub and a suction sub comprising:

sensors that generate monitoring data of the ESP; and wireless transmitters that wirelessly transmit the monitoring data, wherein the discharge sub couples the ESP to the production tubing and includes at least a first one of the sensors, wherein the suction sub couples the ESP to the electrical motor and includes at least a second one of the sensors, wherein the sensors of the discharge sub measure discharge pressure of the well fluid at an outlet of the ESP, and wherein the sensors of the suction sub measure suction pressure of the well fluid at an inlet of the ESP;

a power sub coupled to the ESP and comprising:

additional sensors that generate additional monitoring data of the ESP; and additional wireless transmitters that wirelessly transmit the additional monitoring data, wherein the additional sensors of the power sub measure mechanical power input to the ESP; and a monitoring sub coupled to the electrical motor, wherein the monitoring sub receives the monitoring data wirelessly transmitted from the discharge sub and the suction sub, wherein the monitoring sub receives the additional monitoring data wirelessly transmitted from the power sub, and wherein the monitoring sub transmits the monitoring data and the additional monitoring data to a downhole flow rate analyzer, wherein the downhole flow rate analyzer determines the downhole flow rate of the well fluid by analyzing the monitoring data and the additional monitoring data, and wherein the determined downhole flow rate is used to facilitate a production operation of the wellbore.

12. The system of claim 11, wherein the monitoring data and the additional monitoring data are transmitted by the monitoring sub to the downhole flow rate analyzer via a power delivery cable of the ESP.

13. The system of claim 11, wherein the sensors of the discharge sub measure discharge temperature of the well fluid at an outlet of the ESP, and wherein the sensors of the suction sub measure suction temperature of the well fluid at an inlet of the ESP.

14. The system of claim 11, wherein the wireless transmitters and the additional wireless transmitters transmit electromagnetic signals.

15. The system of claim 11, the monitoring sub comprising sensors that generate additional monitoring data comprising measurements of one or more of motor oil and winding temperature, intake and discharge pressure, and mechanical vibration, wherein the additional monitoring data is combined with the monitoring data for transmitting to the downhole flow rate analyzer for determining the downhole flow rate, and wherein the downhole flow rate analyzer is disposed at the Earth surface or integrated within the monitoring sub.

* * * * *